US006435148B1

(12) United States Patent
Haas et al.

(10) Patent No.: US 6,435,148 B1
(45) Date of Patent: Aug. 20, 2002

(54) SWITCHABLE SUPPORT ELEMENT

(75) Inventors: Michael Haas; Bodo Rörig, both of Weisendorf; Dieter Schmidt, Nürnberg; Joachim Seitz, Reundorf, all of (DE)

(73) Assignee: INA Walzlager Schaeffler oHG (DE)

( * ) Notice: Subject to any disclaimer, the term of this patent is extended or adjusted under 35 U.S.C. 154(b) by 0 days.

(21) Appl. No.: 09/946,566

(22) Filed: Sep. 5, 2001

Related U.S. Application Data

(60) Provisional application No. 60/237,301, filed on Oct. 2, 2000.

(51) Int. Cl.[7] ..... F01L 1/12; F01L 1/24

(52) U.S. Cl. ..... 123/90.16; 123/90.41; 123/90.43

(58) Field of Search ..... 123/90.15, 90.16, 123/90.39, 90.41, 90.43, 90.45, 90.46, 198 F

(56) References Cited

U.S. PATENT DOCUMENTS 5,099,806 A * 3/1992 Murata et al. ..... 123/90.16
5,655,487 A * 8/1997 Maas et al. ..... 123/90.16
5,720,244 A * 2/1998 Faria ..... 123/90.16
6,321,704 B1 * 11/2001 Church et al. ..... 123/90.16

FOREIGN PATENT DOCUMENTS

DE 4422340 A1 * 1/1995

* cited by examiner

*Primary Examiner*—Weilun Lo
(74) *Attorney, Agent, or Firm*—Bierman, Muserlian and Lucas

(57) ABSTRACT

A switchable support element (1) requiring only a small design space. For this purpose, a slide (12) that serves to couple an inner element (6) to an outer housing (3) in the support element (1) is positioned laterally in a housing (2) arranged in the cylinder head (5). At the same time, a bore (8) in the inner element (6) for the slide (12) is made as a pocket bore, the housing (2) being seated through an annular extension (11) directly in a bore (9) of the outer housing (3). The slide (12) can be displaced electromagnetically or hydraulically in at least

8 Claims, 1 Drawing Sheet

SWITCHABLE SUPPORT ELEMENT

This application claims priority from provisional application No. 60/237,301, filed Oct. 2, 2000.

FIELD OF THE INVENTION

The invention concerns a switchable support element for a finger lever of a valve train of an internal combustion engine, said support element being installed in a cylinder head of an internal combustion engine and comprising an outer housing, an inner element, a slide and a housing for the slide, said outer housing being installed in a reception of the cylinder head and receiving the inner element for axial displacement, a bore provided in the inner element and a bore provided in the outer housing being aligned to each other in a relative axial position, the slide being at least partially displaceable out of the housing into said bores for coupling the inner element to the outer housing, and the housing being seated in the cylinder head with an inner end adjacent the bore of the outer housing.

BACKGROUND OF THE INVENTION

A support element of the pre-cited type considered to be generic is known from DE 44 22 340 A1. This support element is likewise switchable but for the purpose of coupling, it is intersected axially beneath its clearance compensation element by a slide. At its end facing away from the support element, the slide extends in a separate housing in the cylinder head. To effect coupling, an end of the slide extends fully through the support element. This document further discloses a so-called lost motion spring that acts on an inner element of the support element axially beneath the slide.

A drawback of the aforesaid support element is that it has a relatively large design height. It must be noted that the clearance compensation element with the slide and the lost motion spring are stacked one on top of the other. Design space problems can arise from the fact that the support element intersects cooling water or gas exchange canals or the like that may be located in this region. It is further noted that the support element cannot be supplied together with the housing for the slide because these are separate components. Due to the separate mounting of the housing for the slide in the cylinder head, misalignments between the slide and the bores provided in the support element for coupling purposes can also occur.

OBJECT OF THE INVENTION

The object of the invention is therefore to provide a switchable support element of the pre-cited type in which the mentioned drawbacks are eliminated.

SUMMARY OF THE INVENTION

The invention achieves this object by the fact that the inner end of the housing comprises an annular extension that is installed in the bore of the outer housing, or that the inner end of the housing is connected to the outer housing by a flange, and the slide is adapted to be operated electromagnetically while being configured as an actuator rod with an armature plate.

In an alternative solution, this object is achieved by a hydraulically displaceable slide and by the fact that the inner end of the housing comprises an annular extension that is installed in the bore of the outer housing, or that the inner end of the housing is connected to the outer housing by a flange.

In a particularly preferred embodiment according to one of the dependent claims, the bores of the inner element and the outer housing extend in radial direction, and the bore of the inner element is made as a pocket bore.

In this way, a support element is created in which the initially cited drawbacks are eliminated. Essentially, this support element does not require more design space than non-switchable support elements so that it can be easily adapted to cylinder heads of conventional design, or, to put it differently, the support element has a shorter length than switchable prior art solutions. This is accomplished on the one hand by the fact that the hitherto used stacked construction is avoided by configuring the bore in the inner element as a pocket bore.

On the other hand, a simple form of loading the slide through means arranged laterally in the cylinder head is provided. If required, the slide and the housing can be supplied together with the switchable support element because the housing can be connected in advance to the outer housing through its annular extension. All that is then required is to provide a longitudinal recess at a suitable location in the cylinder head for inserting the housing. However, it is also conceivable to have a separate housing and insert it laterally into the cylinder head and connect it to the outer housing through its annular extension.

Due to the preferred press fit between the annular extension and the outer housing the possible prior art alignment errors between the housing, and thus between the slide and the bores in the support element are effectively avoided.

Advantageously, according to a further embodiment of the invention, a hydraulic clearance compensation element, known per se, is installed in the support element. Thus, mechanical or hydraulic clearance adjusting measures at other locations in the valve drive can be dispensed with.

Further dependent claims relate to alternative modes of operating the slide. For example, this can be loaded electromagnetically in at least one direction of displacement. However, it is also conceivable to load the slide electromagnetically in both its directions of displacement. For this, the slide comprises an armature plate that may be formed integrally therewith and likewise extend in the housing.

For the electromagnetic or hydraulic displacement of the slide in at least one direction, pressurelessly locked or unlocked configurations, such as are known per se in the technical field, are also conceivable.

If, as alternatively proposed, the slide is displaced hydraulically in at least one direction of displacement, it may be displaced in the opposite direction by the force of a spring means such as at least one compression spring or also by a hydraulic medium. Appropriately, the hydraulic medium is routed out of the cylinder head adjacent the housing into a pressure chamber situated in front of a pressure plate of the slide.

It is both conceivable and provided for by the invention to make the annular extension of the housing as a separate component. This can be of advantage from the fabrication and assembly point of view. A simple way of connecting the annular extension to the housing is to make a snap connection using a locking ring. But a force-locked or positive engagement is also conceivable for this purpose.

In place of the aforesaid press fit between the annular extension and the outer housing, it can also be advantageous to connect the housing to the outer housing through a flange.

BRIEF DESCRIPTION OF THE DRAWING

The invention will now be described more closely with reference to the drawing which shows in.

DETAILED DESCRIPTION OF THE DRAWINGS

Figure 1:
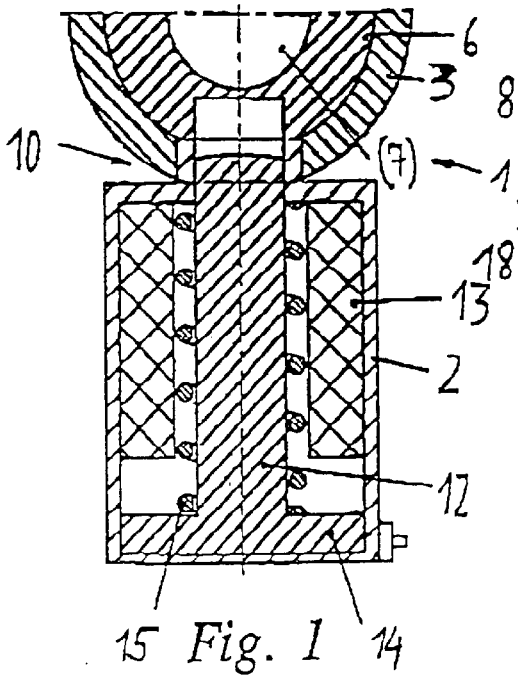
FIGS. 1 to 4, cross-sections through the switchable support element and the housing, FIGS. 1, 2 showing an electromagnetically displaceable slide and, FIGS. 3, 4 showing a hydraulically displaceable slide.

FIGS. 1 to 4 disclose a switchable support element 1 with a laterally arranged housing 2. The basic structure of this support element is known in the technical field (see also DE 44 22 340 A1). The support element 1 has an outer housing 3 that is fixedly installed in a reception 4 of a roughly indicated cylinder head 5. An axially displaceable inner element 6 is received in the outer housing 3. The inner element 6 may comprise a hydraulic clearance compensation element 7 (not explicitly illustrated). The inner element 6 comprises a head for supporting one end of a finger lever.

Each of the outer housing 3 and the inner element 6 comprises a bore 9, 8. The bore 8 in the inner element 6 is made as a pocket bore, while the bore 9 in the outer housing 3 is configured as a through-bore. The two bores 8, 9 are aligned to each other in one relative axial position of the inner element 6 and the outer housing 3. This relative position is defined by an axially extended state of the inner element 6 relative to the outer housing 3 for accomplishing a complete lift of the gas exchange valve actuated by the finger lever.

As can be seen further in FIGS. 1 to 4, the bush-like housing 2 extends in the cylinder head 5 at a right angle to the longitudinal axis of the support element 1 and the inner end 10 of the housing 2 directly adjoins the outer housing 3. In the region of its inner end 10, the housing 2 comprises an annular extension 11 that is, for example, pressed into the bore 9.

A slide 12 extends in the housing 2 and, thus, laterally in the cylinder head 5. For switching on the support element 1, the slide 12 couples the inner element 6 to the outer housing 3. In the switched-off state, the slide 12 extends at the most up to a point immediately in front of the bore 8 of the inner element 6. For switching on the support element 1, the slide 12 is displaced partially into the bore 8 of the inner element 6 during a base circle phase of a cam by which the finger lever is actuated.

Figure 2:
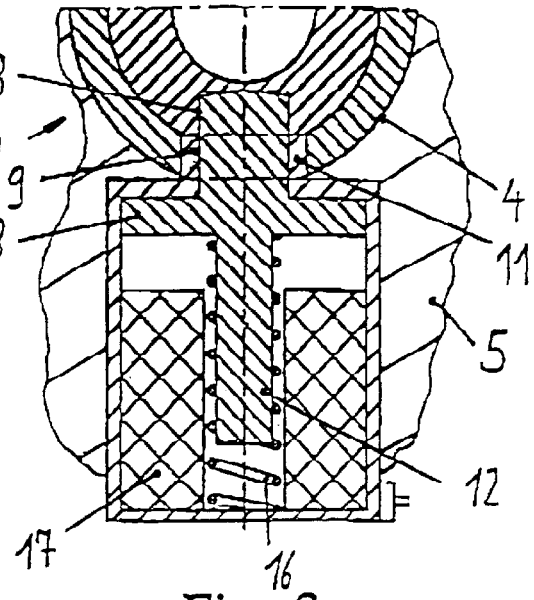

FIGS. 1 and 2 show electromagnet modes of displacing the slide 12, each in a different direction. In FIG. 1, the slide 12 is displaced in its coupling direction by the force of an electromagnet 13 positioned in the housing 2. When the electromagnet 13 is energized, an armature plate 14 connected to an end of the slide 12 is displaced toward the electromagnet 13. In this way, the coupling of the outer housing 3 to the inner element 6 is realized by the displacement of the slide 12 into the bore 8. This movement of displacement is effected against the force of a spring means 15 (FIG. 1) that is configured in the present case as a compression spring and surrounds the slide 12. For uncoupling, the electromagnet 13 is deenergized so that the force of the spring means 15 re-displaces the slide 12 into the housing 2.

FIG. 2 shows that, in contrast to FIG. 1, the displacement of the slide 12 in coupling direction is effected by the force of a spring means 16 such as a compression spring, and in uncoupling direction, by the force of an electromagnet 17. An armature plate 18 is arranged on one side of the annular extension 11.

Figure 3:
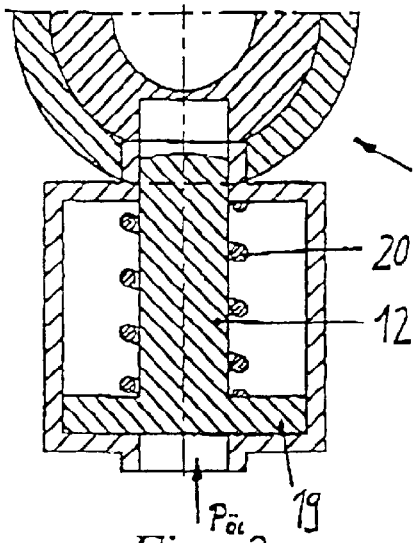
Figure 4:
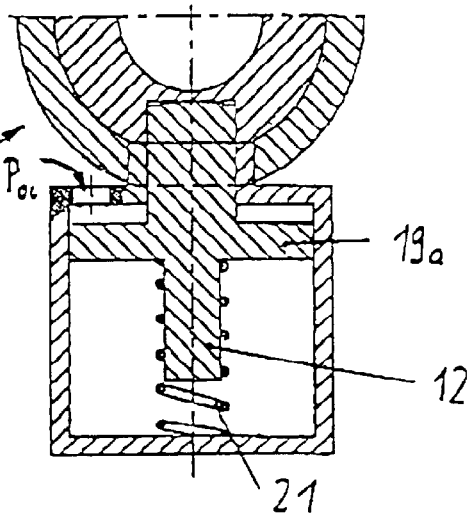

FIGS. 3 and 4 show hydraulic modes of displacing the slide 12. As can be seen in FIG. 3, the slide 12 can be displaced in its coupling direction by a hydraulic medium applied to its pressure plate 19. A return displacement is again achieved by the force of at least one spring means 20 such as a compression spring.

As an alternative to FIG. 3, FIG. 4 shows that the displacement of the slide 12 into its uncoupling position is realized by applying hydraulic medium pressure to its pressure plate 19*a*, and its displacement into the coupling position, by the force of a spring means 21 such as a compression spring.

It goes without saying that it is conceivable and within the scope of the invention to displace the slide in both its directions of displacement by electromagnetic means or exclusively by hydraulic oil pressure.

Figure 5:
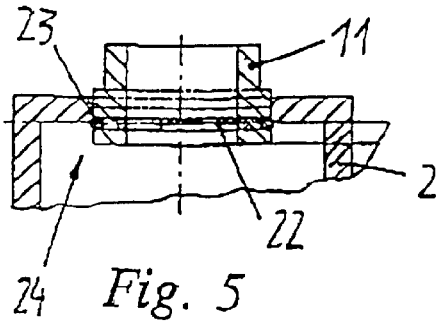
FIG. 5, a housing in the cylinder head, whose annular extension is made separately.

FIG. 5 shows that the annular extension 11 of the housing 2 can also be made separately. This annular extension then has on its outer peripheral surface, an annular groove 22 in which a locking ring 23 extends. Through this locking ring 23, a snap connection 24 is made between the housing 2 and the annular extension 11.

Figure 6:
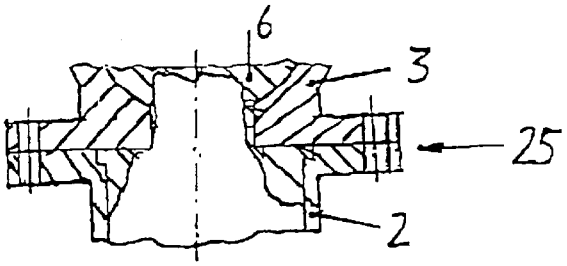
FIG. 6, an alternative way of connecting the housing to the outer housing through a flange.

Finally, FIG. 6 shows that the housing 2 can also be connected to the outer housing 3 by a flange 25. Advantageously, the flange 25 is arranged so that it does not intersect any cooling water or gas exchange canals and the like that may be present and that it does not impede the operation of the support element 1.

A particular advantage of the invention is that, due to the lateral arrangement of the slide 12 in the housing 2, the overall height of the support element 1 is essentially not as large as that of prior art non-switchable support elements. At the same time, the connection of the annular extension 11 to the outer housing 3 results in an excellent positional correspondence of the slide 12 to the bores 8, 9.

Reference Numerals

1 Support element
2 Housing
3 Outer housing
4 Reception
5 Cylinder head
6 Inner element
7 Hydraulic clearance compensation element
8 Bore
9 Bore
10 Inner end
11 Annular extension
12 Slide
13 Electromagnet
14 Armature plate
15 Spring means
16 Spring means
17 Electromagnet
18 Armature plate
19 Pressure plate
20 Spring means
21 Spring means
22 Annular groove

23 Locking ring

24 Snap connection

25 Flange

What is claimed is:

1. A switchable support element (1) for a finger lever of a valve train of an internal combustion engine, said support element (1) being installed in a cylinder head of an internal combustion engine and comprising an outer housing (3), an inner element (6), a slide (12) and a housing (2) for the slide (12), said outer housing (3) being installed in a reception (4) of the cylinder head (5) and receiving the inner element (6) for axial displacement, a bore (8) provided in the inner element (6) and a bore (9) provided in the outer housing (3) being aligned to each other in a relative axial position, the slide (12) being at least partially displaceable out of the housing (2) into said bores (8, 9) for coupling the inner element (6) to the outer housing (3), and the housing (2) being seated in the cylinder head (5) with an inner end (10) adjacent the bore (9) of the outer housing (3), characterized in that the inner end (10) of the housing (2) comprises an annular extension (11) that is installed in the bore (9) of the outer housing (3), or that the inner end (10) of the housing (2) is connected to the outer housing (3) by a flange (25), and the slide (12) is adapted to be operated electromagnetically while being configured as an actuator rod with an armature plate (14, 18) (FIGS. 1, 2, 6).

2. A support element according to the preamble of claim 1, wherein said slide (12) is hydraulically displaceable and configured as a piston rod with a pressure plate **(19, 19*a*)**.

3. A support element according to claim 1, characterized in that the bores (8, 9) of the, inner element (6) and the outer housing (3) extend in radial direction, and the bore (8) of the inner element (6) is made as a pocket bore.

4. A support element according to claim 3, characterized in that a hydraulic clearance compensation element (7) is installed in the inner element (6), and an axial line of the bore (8) of the inner element (6) intersects the clearance compensation element (7).

5. A support element according to claim 1, characterized in that the slide (12) is displaceable in uncoupling direction by the force of at least one spring means (15, 20) including a compression spring and in coupling direction, by the force of an electromagnet (13) or by a hydraulic medium.

6. A support element according to claim 1, characterized in that the slide (12) is displaceable in coupling direction by the force of at least one spring means (16, 21) including a compression spring and in uncoupling direction, by the force of an electromagnet (17) or by a hydraulic medium.

7. A support element according to claim 1, characterized in that the annular extension (11) is made separately from the housing (2) (FIG. 5).

8. A support element according to claim 7, characterized in that on an end nearer the housing (2), the annular extension (11) comprises an annular groove (22) having a locking ring (23) through which the housing (2) forms a snap connection (24) with the annular extension (11).

* * * * *